US009041497B2

(12) United States Patent
Yang

(10) Patent No.: US 9,041,497 B2
(45) Date of Patent: May 26, 2015

(54) MINIMAL INTRUSION VERY LOW INSERTION LOSS TECHNIQUE TO INSERT A DEVICE TO A SEMI-RIGID COAXIAL TRANSMISSION LINE

(71) Applicant: Kei-Wean Calvin Yang, Beaverton, OR (US)

(72) Inventor: Kei-Wean Calvin Yang, Beaverton, OR (US)

(73) Assignee: TEKTRONIX, INC., Beaverton, OR (US)

( * ) Notice: Subject to any disclaimer, the term of this patent is extended or adjusted under 35 U.S.C. 154(b) by 207 days.

(21) Appl. No.: 13/713,220

(22) Filed: Dec. 13, 2012

(65) Prior Publication Data

US 2013/0285770 A1 Oct. 31, 2013

Related U.S. Application Data

(60) Provisional application No. 61/639,822, filed on Apr. 27, 2012.

(51) Int. Cl.
*H01P 3/06* (2006.01)
*H01P 11/00* (2006.01)

(52) U.S. Cl.
CPC ..... *H01P 3/06* (2013.01); *H01P 11/005* (2013.01)

(58) Field of Classification Search
CPC ..... H01P 3/06; H01P 11/005
USPC ..... 333/245; 29/828
See application file for complete search history.

(56) References Cited

U.S. PATENT DOCUMENTS 5,382,932 A * 1/1995 Monti ..... 333/245
7,518,952 B1 4/2009 Padden

FOREIGN PATENT DOCUMENTS

| | | | |
|---|---|---|---|
| EP | 1860725 | A2 | 11/2007 |
| EP | 2043193 | A1 | 4/2009 |
| EP | 2372830 | A1 | 10/2011 |
| WO | 2004079795 | A2 | 9/2004 |
| WO | 2005093896 | A1 | 10/2005 |

OTHER PUBLICATIONS

European Search Report from EP No. 13165662.1, dated Jul. 24, 2013, 7 pages.

* cited by examiner

*Primary Examiner* — Benny Lee
(74) *Attorney, Agent, or Firm* — Marger Johnson & McCollom PC; Thomas F. Lenihan

(57) ABSTRACT

A signal conditioning apparatus can include a coaxial cable having at least one slot formed therein. A conductive film can be applied to the coaxial cable so as to cover each slot. A device mounting surface can be formed within the slot and a protection device can be mounted on the device mounting surface. A housing consisting of one or more interlockable portions can be coupled to the coaxial cable.

17 Claims, 9 Drawing Sheets

MINIMAL INTRUSION VERY LOW INSERTION LOSS TECHNIQUE TO INSERT A DEVICE TO A SEMI-RIGID COAXIAL TRANSMISSION LINE

CROSS-REFERENCE TO RELATED APPLICATION

The present application claims the benefit of U.S. Provisional Patent Application No. 61/639,822, titled "A MINIMAL INTRUSION VERY LOW INSERTION LOSS TECHNIQUE TO INSERT A DEVICE TO A SEMI-RIGID COAXIAL TRANSMISSION LINE" and filed on Apr. 27, 2012, the content of which is hereby fully incorporated by reference herein.

BACKGROUND

In high frequency signal applications, there is often a need to condition signals before delivering them to another stage. In order to meet those requirements, filters, attenuators, DC blocks, and power splitters are typically employed as standalone devices that can be inserted into the signal transmission path. To minimize fixture complications, an inline design of such elements that can be directly inserted into the signal transmission path via two connector pairs tends to be the most popular design. However, high frequency launches used to fabricate such devices are expensive and generally cause return losses due to manufacturing tolerances. These return losses are then characteristics of each individual launch and cannot be compensated out. Such devices also are generally quite large because of the housing and coplanar waveguide used to support the designated device.

Accordingly, a need remains for improved approaches for incorporating one or more devices into a semi-rigid high frequency transmission cable system.

SUMMARY OF THE INVENTION

The disclosed technology generally pertains to various techniques for incorporating a device or component, e.g., a serial device or a parallel device, into a semi-rigid high frequency transmission cable system. Compared to conventional connectorized standalone devices, embodiments in accordance with the disclosed technology are generally significantly more economical and compact than such conventional solutions. Also, interruptions to the transmission line characteristic impedance from modifying the cable system for element insertion in accordance with the disclosed technology can be compensated to almost a negligible level.

DETAILED DESCRIPTION OF THE INVENTION

Embodiments of the disclosed technology generally include techniques for incorporating a particular device or component, such as a serial device or a parallel device, into a semi-rigid high frequency transmission cable system. These and other features and embodiments of the present invention proceed with reference to each of the figures.

Figure 1:
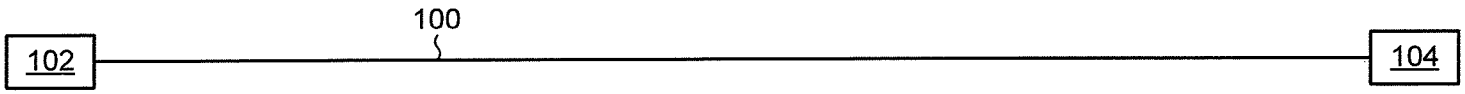
FIGURE 1 CONVENTIONAL ART
FIG. 1 illustrates an example of a conventional coaxial transmission line having two connectors, one at each end.

FIG. 1 illustrates an example of a conventional coaxial transmission line 100 having two connectors 102 and 104, one at each end. In conventional designs for connecting an electrostatic discharge (ESD) protection diode 120 to the center conductor of the coaxial cable 100 of FIG. 1, a user must first break up the coaxial cable 100 of FIG. 1 into two shorter segments 110 and 112, place additional connector pairs 114A-114B and 116A-116B at the newly-created ends, and then insert an inline element 118 that is housing the protection diode 120, as illustrated by FIG. 2.

Figure 2:
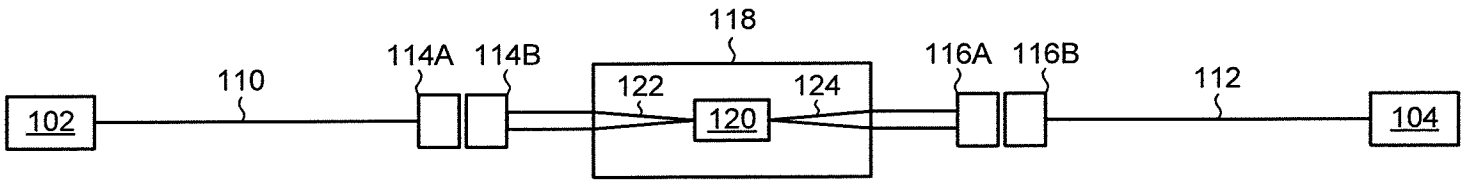
FIGURE 2 CONVENTIONAL ART
FIG. 2 illustrates an example of a conventional inline radio frequency (RF) element inserted into the transmission line of FIG. 1.

FIG. 2 demonstrates that, to insert the element 118, one would need, in addition to the extra connector pairs 114A-114B (between the element 118 and a connector 102) and 116A-116B (between the element 118 and a connector 104), two radio frequency (RF) launches 122 and 124, a coplanar waveguide environment (not shown) to host the ESD diode, and the overall housing to support the waveguide, RF launches 122 and 124, and new connectors 114A-114B and 116A-116B. These extra connector pairs 114A-114B and 116A-116B, RF launches 122 and 124, and coplanar waveguide typically cause discontinuities. The various impedance mismatches due to production tolerance control makes the connector system a return loss site. Also, these mismatches cannot be eliminated because of the variation in production controls.

Embodiments of the disclosed technology generally include elimination of the extra elements described above. In accordance with certain embodiments, the coplanar waveguide substrate where the protection diode is to be mounted is generally a tiny flat surface carved out of a semi-rigid coaxial cable. In such embodiments, the impedance mismatches between substrate and launch, launch and coxial cable, and coaxial cable and connector that were inevitable in conventional designs are now eliminated. After device insertion, the balance of impedance mismatches at the device insertion point can be compensated as a subsequent touch-up process.

Figure 3:
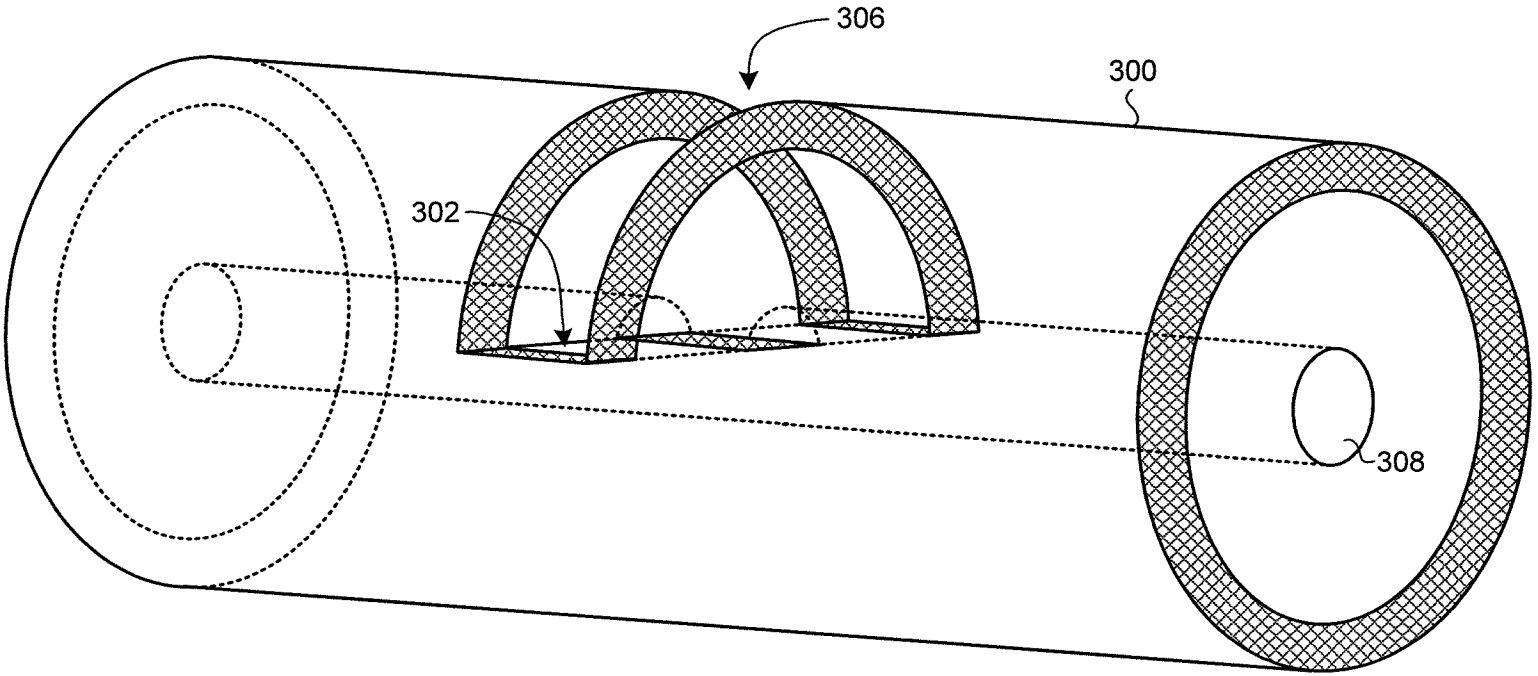
FIG. 3 illustrates a device mounting surface that is shaped out of a semi-rigid cable itself in accordance with certain embodiments of the disclosed technology.

FIG. 3 illustrates a device mounting surface 302 that is shaped out of a semi-rigid coaxial cable 300 itself in accordance with certain embodiments of the disclosed technology. In the example, this "substrate" is created by slicing a slot 306 at least approximately halfway into the center conductor 308 of the semi-rigid coaxial cable 300. In other embodiments, the slot 306 may extend less than—or more than—halfway, e.g., a third of the way, into the center conductor 308. Following a nickel (Ni) barrier and thick gold (Au) plating, for example, components can be directly bonded to this "coplanar waveguide" with only insignificant interruptions to the environment of the semi-rigid coaxial cable 300.

Figure 4A:
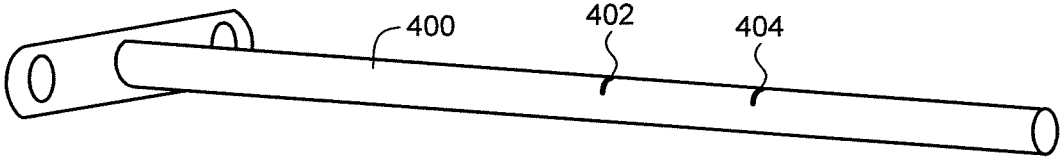
FIG. 4A illustrates a first view of a semi-rigid cable having a device mounting surface, such as that illustrated by FIG. 3, in accordance with certain embodiments of the disclosed technology.
Figure 4B:
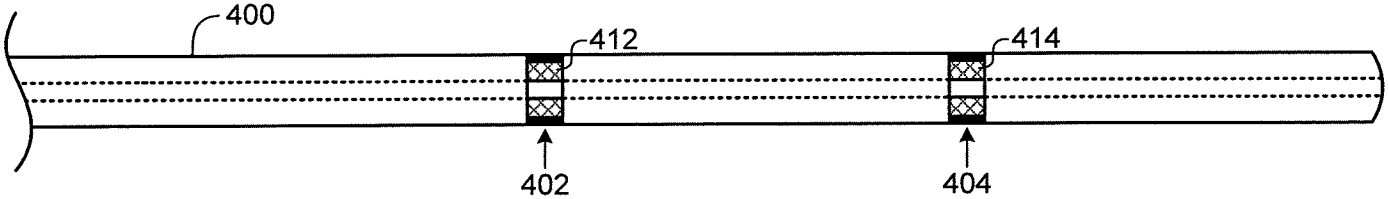
FIG. 4B illustrates a second view of the semi-rigid cable illustrated by FIG. 4A.

FIGS. 4A and 4B illustrate two views of a semi-rigid coaxial cable 400 having multiple device mounting surfaces 412 and 414, in accordance with certain embodiments of the disclosed technology. In the example, the device mounting surfaces 412 and 414 result from the generation of narrow (e.g., 20-30 millimeter) slots 402 and 404, respectively, that have been cut into the semi-rigid coaxial cable 400. In other embodiments, the slots may have a width in the range of 10-60 millimeters. The coplanar waveguide-like "substrate surface" shaped out of the semi-rigid coaxial cable 400 may be plated with a suitable material, e.g., gold, for mounting the protection device thereon. This "coplanar waveguide" thus has a hybrid bottom half that still retains the original structure of the semi-rigid coaxial cable 400.

Figure 5:
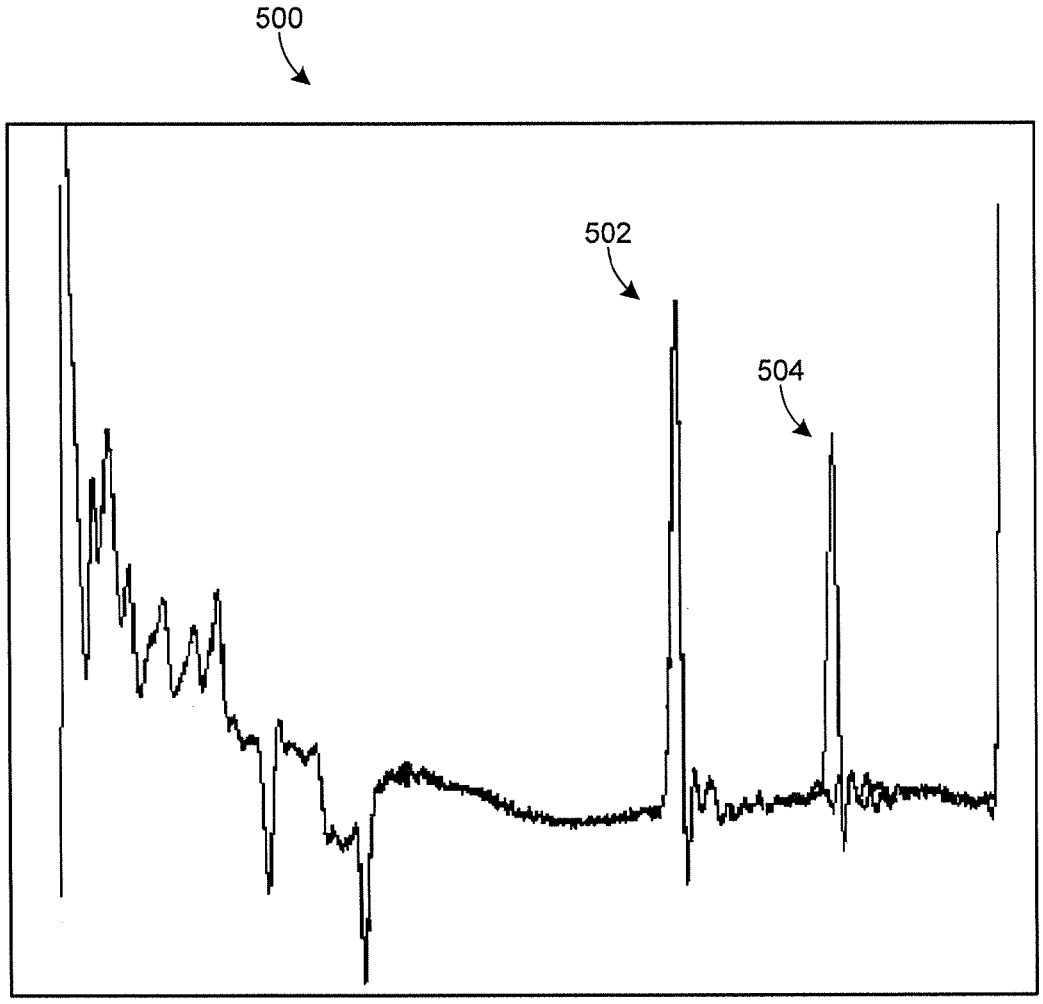
FIG. 5 illustrates an example of a time domain reflectometry (TDR) response for the semi-rigid cable illustrated by FIG. 4 in accordance with certain embodiments of the disclosed technology.

FIG. 5 illustrates an example of a time domain reflectometry (TDR) response 500 for the semi-rigid cable 400 illustrated by FIGS. 4A and 4B in accordance with certain embodiments of the disclosed technology. In the example, the TDR response 500 indicates that the slots 402 and 404 create impedance mismatch spikes 502 and 504, respectively. By using a capacitance compensation technique, however, such as that described below with regard to FIGS. 6A and 6B, the impedance from the discontinuities resulting from the slots 402 and 404 can be almost completely compensated out as demonstrated by the reduced mismatch spikes 702 and 704 of FIG. 7.

Figure 6A:
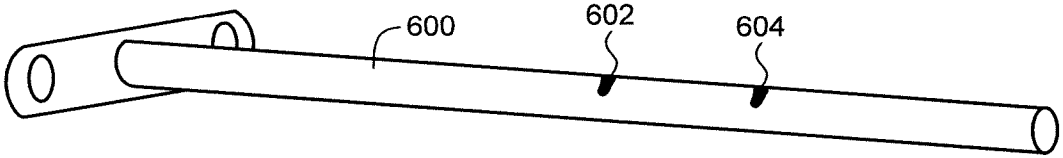
FIG. 6A illustrates a first view of a semi-rigid cable having an electrostatic discharge (ESD) protector in accordance with certain embodiments of the disclosed technology.
Figure 6B:
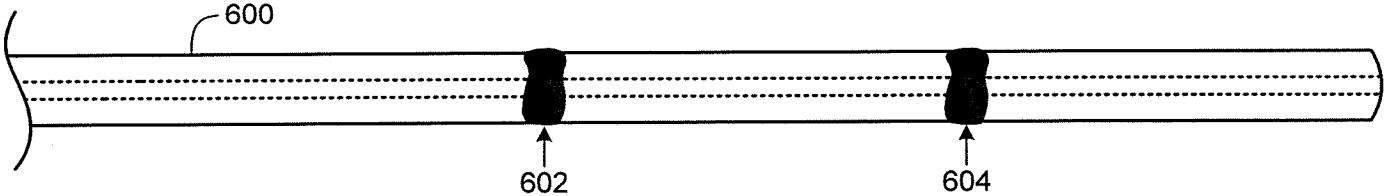
FIG. 6B illustrates a second view of the semi-rigid cable illustrated by FIG. 8A.
Figure 7:
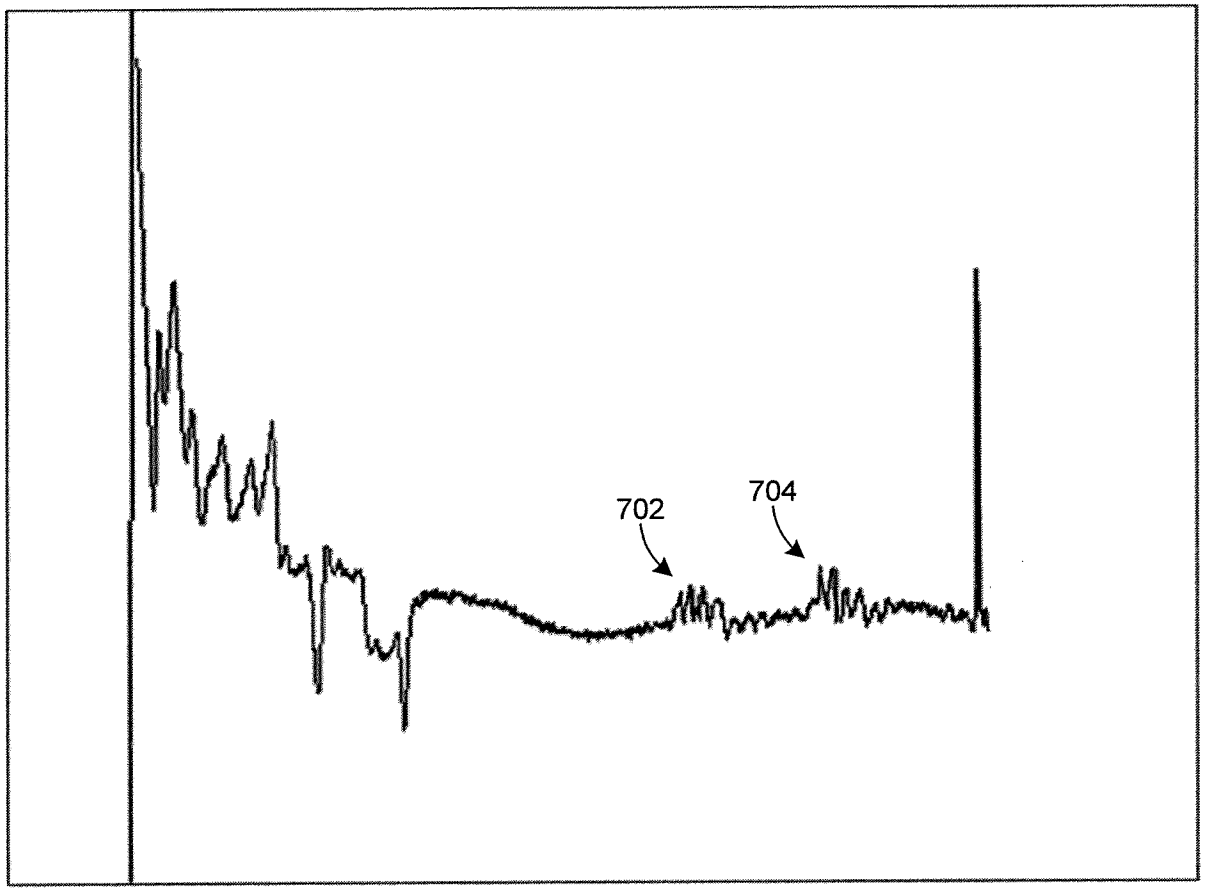
FIG. 7 illustrates an example of a TDR response for the semi-rigid cable illustrated by FIGS. 6A and 6B in accordance with certain embodiments of the disclosed technology.

FIGS. 6A and 6B illustrate two views of a semi-rigid coaxial cable 600 having an electrostatic discharge (ESD) protector in accordance with certain embodiments of the disclosed technology. In the example, a suitable material, e.g., nickel-gold, is applied to, e.g., plated on, each of a number of slots, such as the slots 402 and 404 of FIGS. 4A and 4B. A protection device, such as an ESD diode or filter, may then be attached thereto. In certain embodiments, a conductive film such as nickel, copper, or gold, may be applied over the material so as to at least substantially cover the slot itself or the outward-facing surface of the base material, as indicated by 602 and 604 in FIGS. 6A and 6B. As noted above, FIG. 7 illustrates an example of a TDR response for the semi-rigid cable illustrated by FIGS. 6A and 6B in which the mismatch spikes 502 and 504 of FIG. 5 have been significantly reduced, as indicated by 702 and 704, respectively.

Figure 8A:
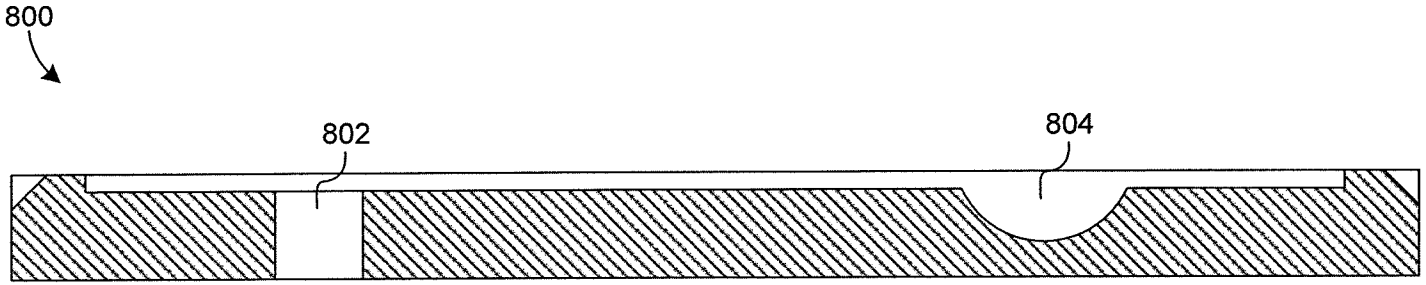
FIG. 8A illustrates a first view of a first portion of a housing that may be attached to a semi-rigid cable such as the cable illustrated by FIGS. 6A and 6B.
Figure 8B:
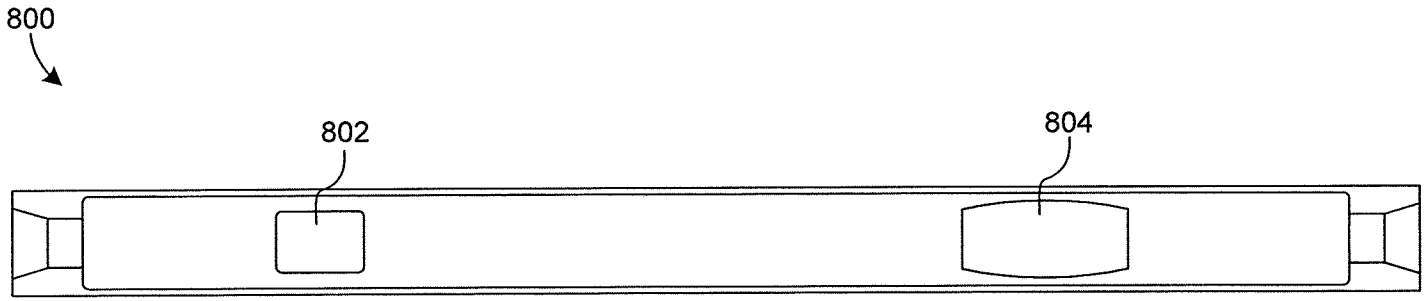
FIG. 8B illustrates a second view of the first portion of the housing illustrated by FIG. 8A.
Figure 8C:
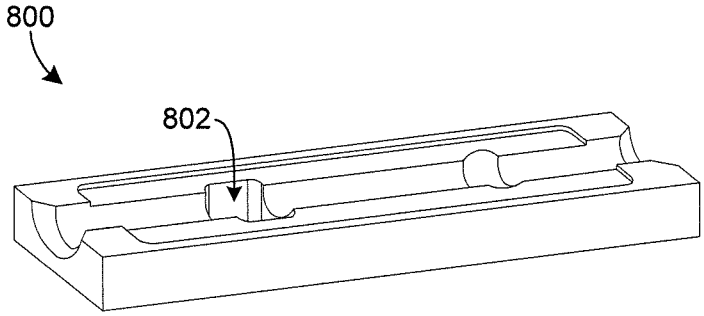
FIG. 8C illustrates a third view of the first portion of the housing illustrated by FIGS. 8A and 8B.

FIGS. 8A-8C illustrate multiple views of a first portion 800 of a protection module housing that may be applied to a semi-rigid cable such as the cable 600 illustrated by FIGS. 6A and 6B, e.g., to provide greater structure reinforcement. In the example, the first portion 800 of the housing includes two cavities 802 and 804 as shown in FIGS. 8A and 8B. Cavity 804 may be sized and shaped to at least substantially cover a conductive film that is applied over a slot such as those described above, for example. In certain embodiments, cavity 802 may be sized and shaped to at least substantially mate with a cavity of another portion. In situations involving a no-flow or low-flow bonding agent, cavity 802 may be omitted from the first portion 800 of the housing.

The first portion 800 of the protection module housing may be formed such that it may mate with a duplicate of itself. Such an arrangement is particularly advantageous in that the first portion 800 may be produced in bulk so that any given two instances may be used together in a mating/locking fashion.

Figure 9:
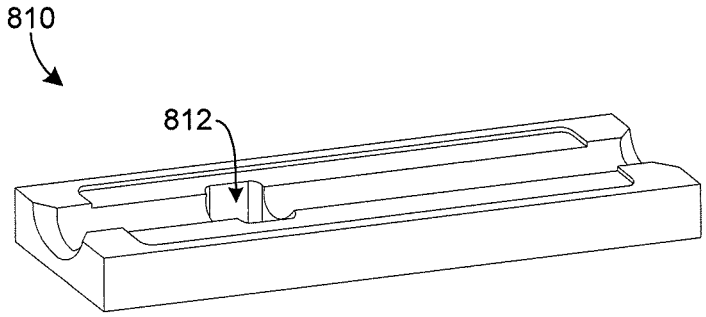
FIG. 9 illustrates a second portion of a housing that is couplable with the first portion of the housing illustrated by FIGS. 8A-8C.

FIG. 9 illustrates a second portion 810 of a protection module housing that may be couplable with the first portion 800 of the protection module housing illustrated by FIGS. 8A-8C. In the example, the second portion 810 has a cavity 812 that may be sized and shaped to at least substantially mate with cavity 802 of the first portion 800. In other embodiments, the cavity 812 is not present or unnecessary for coupling of the two portions 800 and 810. Alternatively or in addition thereto, the second portion 810 has a second cavity (not shown) that may be sized and shaped to at least substantially match cavity 804 of the first portion 800. This arrangement is particularly useful for embodiments in which the conductive film wraps completely around the semi-rigid cable rather than just directly over the slot.

Figure 10:
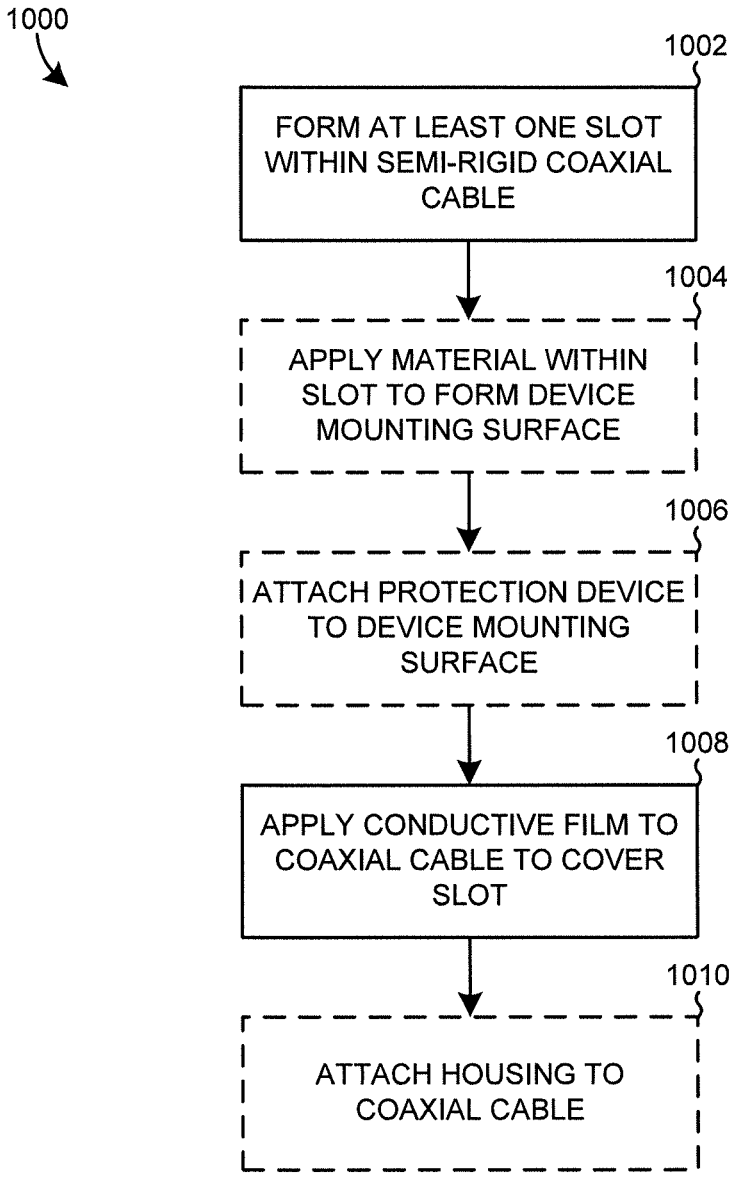
FIG. 10 is a flowchart illustrating an example of a method for producing a signal conditioning apparatus in accordance with certain embodiments of the disclosed technology.

FIG. 10 is a flowchart illustrating an example of a method 1000 for producing a signal conditioning apparatus in accordance with certain embodiments of the disclosed technology. At 1002, at least one slot is formed within a semi-rigid coaxial cable. The slot(s) may be formed by way of a high-speed cutter using a fine diameter diamond blade, for example.

At 1004, a material may be optionally applied within the slot so as to form a device mounting surface. The material may be gold, for example, and may be applied by way of sonic bonding, beam lead, or use of an epoxy. At 1006, a protection device, e.g., an ESD diode or other device or component, may be optionally attached to the device mounting surface. At 1008, a conductive film such as gold, copper, or nickel, may be applied to the cable such that the film substantially or completely covers the slot itself or the outward-facing surface of the material applied at 1004.

At 1010, a housing may be attached to or otherwise coupled with the cable so as to cover the slot or conductive film. This housing may include a single piece or multiple portions that may be formed so as to interlock with each other, for example.

Having described and illustrated the principles of the invention with reference to illustrated embodiments, it will be recognized that the illustrated embodiments may be modified in arrangement and detail without departing from such principles, and may be combined in any desired manner. And although the foregoing discussion has focused on particular embodiments, other configurations are contemplated. In particular, even though expressions such as "according to an embodiment of the invention" or the like are used herein, these phrases are meant to generally reference embodiment possibilities, and are not intended to limit the invention to particular embodiment configurations. As used herein, these terms may reference the same or different embodiments that are combinable into other embodiments.

Consequently, in view of the wide variety of permutations to the embodiments described herein, this detailed description and accompanying material is intended to be illustrative only, and should not be taken as limiting the scope of the invention. What is claimed as the invention, therefore, is all such modifications as may come within the scope and spirit of the following claims and equivalents thereto.

The invention claimed is:

1. A signal conditioning apparatus, comprising:

a coaxial cable comprising at least one slot formed therein, each slot extending to a conductive core of the coaxial cable;

a conductive film applied to the coaxial cable such that the conductive film at least substantially covers the at least one slot; and a protective housing to cover the conductive film, wherein the housing comprises two portions configured to interlock with each other so as to remain fixedly coupled with the coaxial cable.

2. The signal conditioning apparatus of claim 1, further comprising a material applied within the at least one slot to form a device mounting surface.

3. The signal conditioning apparatus of claim 2, wherein the material comprises nickel-gold.

4. The signal conditioning apparatus of claim 2, wherein the material is applied by way of a plating operation.

5. The signal conditioning apparatus of claim 2, further comprising a protective device mounted to the device mounting surface.

6. The signal conditioning apparatus of claim 5, wherein the protective device comprises an electrostatic discharge diode.

7. The signal conditioning apparatus of claim 1, wherein the conductive film comprises nickel, gold, or copper.

8. The signal conditioning apparatus of claim 1, wherein the coaxial cable is at least semi-rigid.

9. A method, comprising:

forming at least a first slot within a coaxial cable, the first slot extending to a conductive core of the coaxial cable, wherein the forming comprises cutting into the coaxial cable by way of a high-speed cutter; and applying a conductive film to the coaxial cable so as to at least substantially cover the first slot.

10. The method of claim 9, further comprising forming a device mounting surface by applying a material to the slot.

11. The method of claim 10, wherein applying the material comprises performing a plating operation.

12. The method of claim 10, wherein the material comprises nickel-gold.

13. The method of claim 10, further comprising attaching a protection device to the device mounting surface.

14. The method of claim 9, wherein the conductive film comprises nickel, gold, or copper.

15. The method of claim 9, wherein the high-speed cutter comprises a diamond blade.

16. The method of claim 9, further comprising:

forming a second slot within the coaxial cable; and applying a second conductive film to the coaxial cable so as to at least substantially cover the second slot.

17. A method, comprising:

forming at least a first slot within a coaxial cable, the first slot extending to a conductive core of the coaxial cable;

applying a conductive film to the coaxial cable so as to at least substantially cover the first slot; and securing a housing to the coaxial cable, wherein securing the housing to the coaxial cable comprises:

coupling a first portion of the housing to the coaxial cable; and coupling a second portion of the housing to the coaxial cable such that the first and second portions interlock.

* * * * *